US006238231B1

(12) United States Patent
Chapman et al.

(10) Patent No.: US 6,238,231 B1
(45) **Date of Patent: *May 29, 2001**

(54) STRAIN RELIEF APPARATUS FOR USE IN A COMMUNICATION PLUG

(75) Inventors: James S. Chapman; Carlos F. Chavez; Lyndon D. Ensz, all of Omaha, NE (US); Carlos Garibay, Indianapolis; George W. Reichard, Jr., Carmel, both of IN (US)

(73) Assignee: Avaya Technology Corp., Miami Lakes, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/922,621

(22) Filed: Sep. 3, 1997

(51) Int. Cl.[7] ..... H01R 11/20

(52) U.S. Cl. ..... 439/404; 439/395; 439/417; 439/425; 439/676

(58) Field of Search ..... 439/404, 417, 439/418, 425, 676, 395, 460

(56) References Cited

U.S. PATENT DOCUMENTS

| | | | | |
|---|---|---|---|---|
| 3,980,380 | * | 9/1976 | Cieniawa et al. | 439/404 |
| 4,002,392 | | 1/1977 | Hardesty | 439/418 |
| 4,402,565 | * | 9/1983 | Poliak | 439/460 |
| 4,431,246 | | 2/1984 | Vaden | 439/404 |
| 4,960,389 | * | 10/1990 | Frantz et al. | 439/404 |
| 4,969,839 | * | 11/1990 | Nilsson | 439/395 |
| 4,978,316 | * | 12/1990 | Yahata | 439/460 |
| 5,186,649 | | 2/1993 | Fortner et al. | 439/460 |
| 5,496,196 | | 3/1996 | Schachtebeck | 439/682 |
| 5,624,274 | * | 4/1997 | Lin | 439/417 |
| 5,662,492 | * | 9/1997 | Weiss | 439/404 |

OTHER PUBLICATIONS

Ensz et al., Patent application entitled: "Low Crosstalk Assembly Structure For Use In A Communication Plug", serial No.: 08/922,920, filed Sep. 3, 1997.

Larsen et al., Patent application entitled: "Low Crosstalk Assembly Structure For Use In A Communication Plug", serial No.: 08/922,580, filed Sep. 3, 1997.

Lin et al., Patent application entitled: "Blade Carrier For Use In A Communication Plug", serial No.: 08/923,382, filed Sep. 3, 1997.

Reichard et al., Patent application entitled: "Alignment Apparatus For Use In The Jack Interface Housing Of A Communication Plug.", serial No. 08/922,623, filed Sep. 3, 1997.

* cited by examiner

*Primary Examiner*—Paula Bradley
*Assistant Examiner*—Truc Nguyen

(57) ABSTRACT

A strain relief housing for use in a communication plug terminating a cable carrying a plurality of conductors. The housing includes a plurality of prongs for segregating the conductors from a cable that is received through a passage in the housing. Means for anchoring the cable in the passage serve to effectively eliminate stress on the electrical connections with the conductors inside the plug. In a preferred embodiment, the strain relief housing segregates the conductors in a substantially circular array, largely conforming to the arrangement of the conductors in a round cable.

17 Claims, 10 Drawing Sheets

STRAIN RELIEF APPARATUS FOR USE IN A COMMUNICATION PLUG

BACKGROUND OF THE INVENTION

1. Field of the Invention

The present invention relates generally to the field of modular communication plugs for terminating cables or conductors.

2. Description of Related Art

In the telecommunications industry, modular plug type connectors are commonly used to connect customer premise equipment (CPE), such as telephones or computers, to a jack in another piece of CPE, such as a modem, or in a wall terminal block. These modular plugs terminate essentially two types of cable or cordage: ribbon type cables and standard round or sheathed cables.

In ribbon type cables, the conductors running therethrough are arranged substantially in a plane and run, substantially parallel, alongside each other throughout the length of the cable. The individual conductors may have their own insulation or may be isolated from one another by channels defined in the jacket of the ribbon cable itself, with the ribbon cable providing the necessary insulation. Conversely, the conductors packaged in a standard round cable may take on a random or intended arrangement with conductors being twisted or wrapped around one another and changing relative positions throughout the cable length.

Traditional modular plugs are well suited for terminating ribbon type cables. Typically, these plugs are of a dielectric, such as plastic, structure in which a set of terminals are mounted side by side in a set of troughs or channels in the plug body such that the terminals match the configuration of the conductors in the cable connected thereto. When the plug is inserted into a jack, the terminals will electrically engage jack springs inside the jack to complete the connection.

A common problem found in these modular plugs is for the conductors to pull away or be pulled away from the terminals inside the plug structure. This can be caused by persons accidentally pulling on the cable, improperly removing the plug from a jack or merely from frequent use. To alleviate the stress on the connections between the conductors and the plug terminals, prior inventors have included an anchoring member in the housing of the dielectric structure. In these designs, the dielectric structure, i.e., the plug, contains a chamber for receiving the cable. The cable is then secured within the chamber via pressure exerted upon the cable jacket by the anchoring member in conjunction with one or more of the chamber walls. U.S. Pat. Nos. 5,186,649 and 4,002,392 to Fortner, et al. and Hardesty contain examples of such strain relief apparatus.

While these modular plugs have been effective in providing strain relief to ribbon type cables, standard round cables or cords pose additional strain relief problems. For example, to terminate a round cable carrying four conductor pairs with an existing modular plug requires the following steps: First, the cable or cord jacket must be stripped to access the enclosed conductors. Next, because the conductors in a conductor pair are generally twisted around one another, the twist must be removed and the conductors oriented to align with the required interface. Aligning the conductors usually involves splitting the conductors in at least one of the pairs and routing these over or under conductors from other pairs while orienting all the conductors in a side-by-side plane. Once the conductors are aligned in a plane, they may be joined to the terminals in the plug. However, the orientation process can result in various conductors of different pairs crossing over each other, thereby inducing crosstalk among the several conductor pairs.

This process of terminating a round cable introduces significant variability in connecting the conductors to the plug terminals and places additional strain on the connections between the conductors and the plug terminals. Because the individual conductors in a conductor pair are often twisted around one another and the conductor pairs themselves are often twisted around one another, the conductor configuration a technician sees when the cable is cut changes based on the longitudinal position of the cut in the cable. Thus, for each assembly, the technician must determine the orientation of the cable first and then follow the steps discussed above to translate that orientation into a side-by-side, generally planar pattern to match the configuration of the terminals in the plug. Moreover, the necessity of splitting the conductors in at least one of the pairs, which is an industry standard, presents another potential for error in making the connections to the plug terminals. In addition, orienting the conductor positions from an essentially circular arrangement into a planar arrangement places additional stress on the conductor-terminal connections.

U.S. Pat. No. 5,496,196 to Winfried Schachtebeck discloses a cable connector in which the connector terminals are arranged in a circular pattern to match more closely the arrangement of conductors held in a round cable. However, the Schachtebeck invention attempts to isolate each individual conductor and apparently requires all conductor pairs to be split before termination to the connector.

Another problem that has plagued modular plug terminated cables of any type is crosstalk between the communication channels represented by the conductor pairs. The jack springs, conductors, and the plug terminals near the jack springs are generally quite close to, and exposed to, one another providing an opportunity for electrical signals from one channel, i.e. conductor pair, to become coupled to another channel, i.e., crosstalk. Crosstalk becomes particularly acute when the conductors are carrying high frequency signals, and interferes with signal quality and overall noise performance. Furthermore, it is often difficult to ensure proper conductive contact between the jack springs and the conductors, which can also be a source of noise.

In addition, the economic aspects of the prior art necessity for the installer to separate out the twisted pairs of conductors and route them to their proper terminals in the plug are of considerable moment. Even if the installer, splicer, or other operator is accurate in the disposition of the conductors, the time consumed by him or her in achieving such accuracy is considerable. Thus, in a single work day, the time spent in properly routing the conductors can add up to a large amount of time, hence money. Where it is appreciated that thousands of such connections are made daily, involving at least hundreds of installers, it can also be appreciated that any reduction in time spent in mounting the plug can be of considerable economic importance.

Accordingly, there exists a need for a high frequency, modular plug that can terminate a standard round cable and that provides a straightforward interface between the conductors in the cable and the plug terminals, involving considerably less assembly time than heretofore, while simultaneously providing strain relief to the cable. In addition, it is desirable that such a plug be capable of optimizing crosstalk through selective tuning. In this context, optimization means reducing crosstalk in the plug or providing a predetermined level of crosstalk to match the requirements of a jack designed to eliminate an expected crosstalk level.

SUMMARY OF THE INVENTION

The present invention is a strain relief housing component for use in a high frequency communication plug that includes several features aimed at overcoming at least some of the deficiencies in the prior art discussed in the foregoing and, to a large extent, meets the aforementioned desiderata. In a preferred embodiment thereof, these deficiencies are overcome in a communication plug comprised of two housing components: a jack interface housing component and the strain relief housing component according to the instant invention. The jack interface housing is designed to complement the jack type in which the plug will be inserted and has a plurality of slots for receiving the jack springs disposed in its upper surface. The strain relief housing component receives the cable carrying conductors to be terminated and is attached to the jack interface housing. A plurality of blades whose electrical characteristics (i.e., capacitance and inductance) are tunable are confined within the two housing components when the plug is assembled. These blades are carried by a blade carrier, which aligns one end of each blade with a conductor held by the strain relief housing and aligns the other end of each blade in a unique slot in the jack interface housing.

The strain relief housing according to the present invention includes a face end and that has a passage extending from a cable entrance end for receiving a cable carrying a plurality of conductors. A plurality of prongs or projections extend from the face end of the housing to segregate or maintain separation of the conductors from one another so as to minimize electrical interference (i.e., crosstalk) between the conductors. In a preferred embodiment, the prongs segregate the conductors in a substantially radial or circular array. Advantageously, the radial arrangement closely conforms to the general configuration of the conductors in the cable, thereby reducing or eliminating the need to map conductors into a linear, side-by-side arrangement as has been necessary heretofore. For terminating conductors arranged in pairs, two types of prongs are used: Conductor separating prongs are used to separate one conductor from another in a conductor pair while segregation prongs are used to separate conductor pairs from one another. Preferably, the segregation prongs are larger than the conductor separating prongs as the segregation prongs are responsible for minimizing electrical interference between the conductor pairs by, in effect, isolating each conductor pair in the radial array. Moreover, each conductor pair remains intact as a pair with no requirement to split one pair and passing its conductors over other conductors as is common in the prior art.

In addition to segregating the conductors, the prongs also define a plurality of control channels for receiving insulation displacement connectors (IDCs) to make the electrical connections with the conductors. With the spatial relationship between the conductors and the IDC connectors defined through the prongs, a technician's task in assembling the communication plug is greatly simplified, resulting in both economic savings and higher quality electrical connections.

Thus, the face end of the strain relief housing, when the housing is mounted to the jack spring housing containing the conductor blades in their carrier, the IDC ends of the blades make connections between the wires and the blades in the proper order. The only effort on the part of the installer is arranging the wires of the cable in their radial pattern as defined by the prongs and control channels.

In accordance with another aspect of the strain relief housing, an anchor bar is provided to reduce stress on the electrical connections made with the conductors. The anchor bar is positioned in an opening in the upper surface of the strain relief housing. Once the cable is in place and the conductors properly aligned by the prongs, the anchor bar can be pivoted down into the housing to engage the cable. When the anchor bar is in this operative position, the cable is secured between the anchor bar and the passage walls inside the housing. Accordingly, relative movements of the cord external to the strain relief housing are effectively isolated and not transmitted to the electrical connections of the conductors inside the strain relief housing.

For ease in removing the communication plug from the jack, the strain relief housing includes a trigger for operating a latch arm on the plug or, more specifically, the jack spring housing. The trigger, being in close proximity to the cable end of the plug, requires less manual dexterity than that required to operate the latch directly.

Additional advantages will become apparent from a consideration of the following description and drawings:

DETAILED DESCRIPTION

Figure 1:
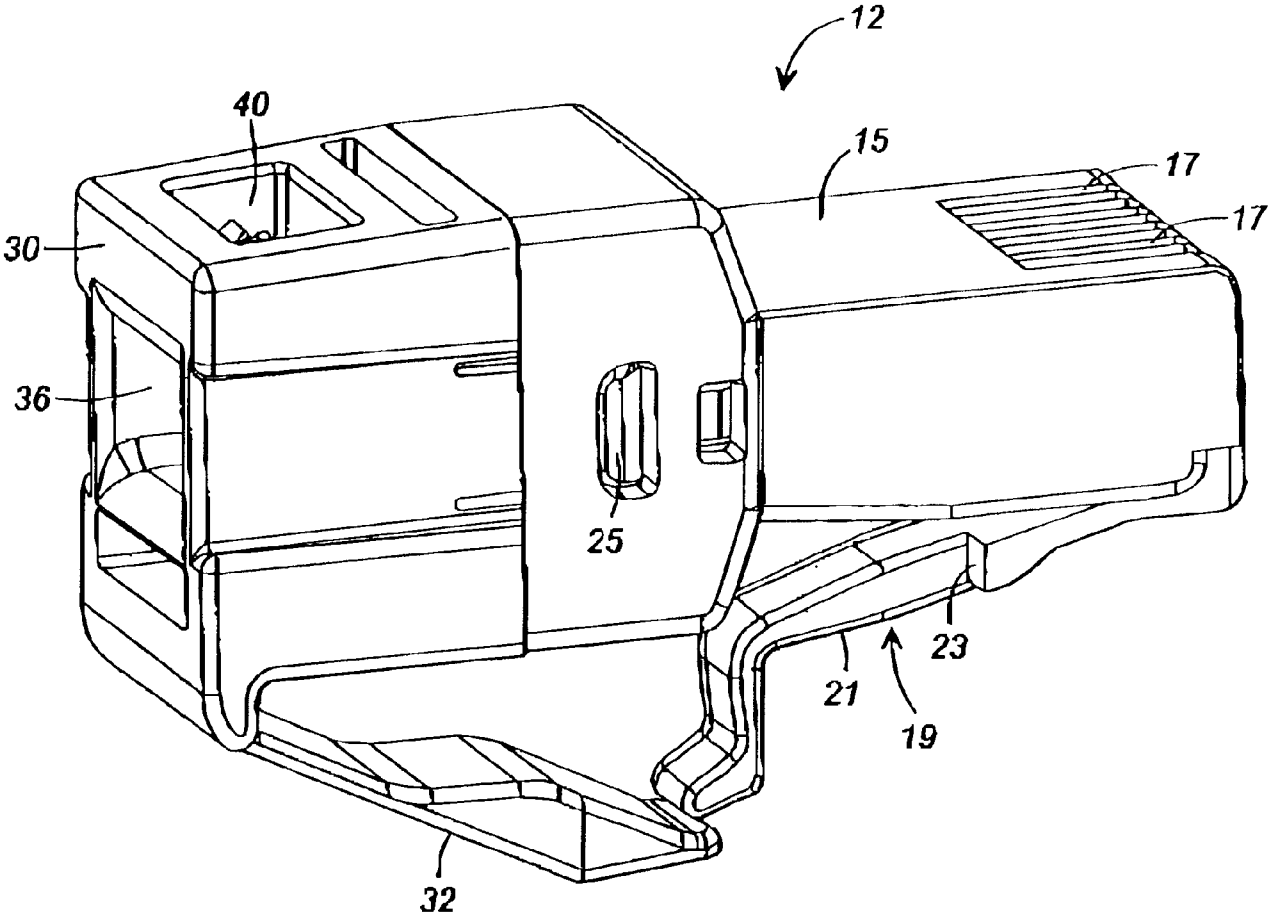
FIG. 1 is a perspective view of the high frequency communication plug according to the present invention.

A preferred embodiment of a high frequency communication plug according to the present invention is shown in FIG. 1. High frequency communication plug 12 includes two major housing components: jack interface housing 15 and strain relief housing 30, both preferably made from a suitable plastic material. Jack interface housing 15 comprises a substantially hollow shell having side walls and upper and lower walls and contains a plurality of slots 17 in one end for receiving jack springs contained in a wall terminal block or other device containing a jack interface (see FIG. 3). The number of slots 17 and dimensions of jack interface housing 15 is dependent on the number of conductors to be terminated and/or connected and the shape of the jack in the terminal block. For most applications, the general shape of jack interface housing 15 remains consistent with the number of slots and the overall width thereof varies in relation to the number of conductors. To secure communication plug 12 in a jack, jack interface housing 15 includes a resilient latch 19 and latch arm 21 extending from its lower surface. Because latch 19 is secured to jack interface housing 15 at only one end, leverage may be applied to arm 21 to raise or lower locking edges 23. When jack interface housing 15 is inserted into a jack, pressure can be applied to arm 21 for easy entry, which, when released, allows arm 21 and locking edges 23 to return to the locking position. Once jack interface housing 15 is seated within the jack, arm 21 can be released causing locking edges 23 to be held behind a plate forming the front of the jack, which is generally standard on such jacks, thereby securing the connection. Similarly, jack interface housing 15 can be released via leverage on arm 21 to free locking edges 23 from behind the jack plate so that jack interface housing 15 can be removed.

The second major housing component is strain relief housing 30, preferably of suitable plastic material. Strain relief housing 30 has a rectangular opening 36, which provides entry for a cable or cord carrying conductors to be terminated. The top surface of strain relief housing 30 includes opening 40, which is involved in providing the strain relief functionality, as will be explained more fully hereinafter. Two side apertures 25 are used for securing strain relief housing 30 to jack interface housing 15. A second pair of side apertures 26 are used for securing carrier 84 (see FIG. 2) to jack interface housing 15. Both of these connections will be discussed hereinafter. For ease in removing communication plug 12 from a jack, trigger 32 extends from the lower surface of strain relief housing 30 to overlap arm 21 when the two housing components 15 and 30 are joined together, as can be seen in FIG. 1. This overlap allows arm 21 to be operated via pressure on trigger 32, which in turn depresses arm 21 to the unlock position, which is more convenient for the user because of its location towards the cable end of communication plug 12. In addition to convenience, trigger 32 provides an important anti-snag feature for arm 21. It is not uncommon for many computer or communication devices to be used together. However, this can often result in a maze of cables and electrical cords. Unfortunately, arm 21 has a tendency to trap other cables or cords between itself and the plug body resulting in damage to arm 21 or breaking arm 21 off the plug altogether. However, with the overlap of arm 21, trigger 32 deters other cables or cords from lodging between either arm 21 or trigger 32 and the plug body, thereby effectively preventing potentially damaging snags.

Figure 2:
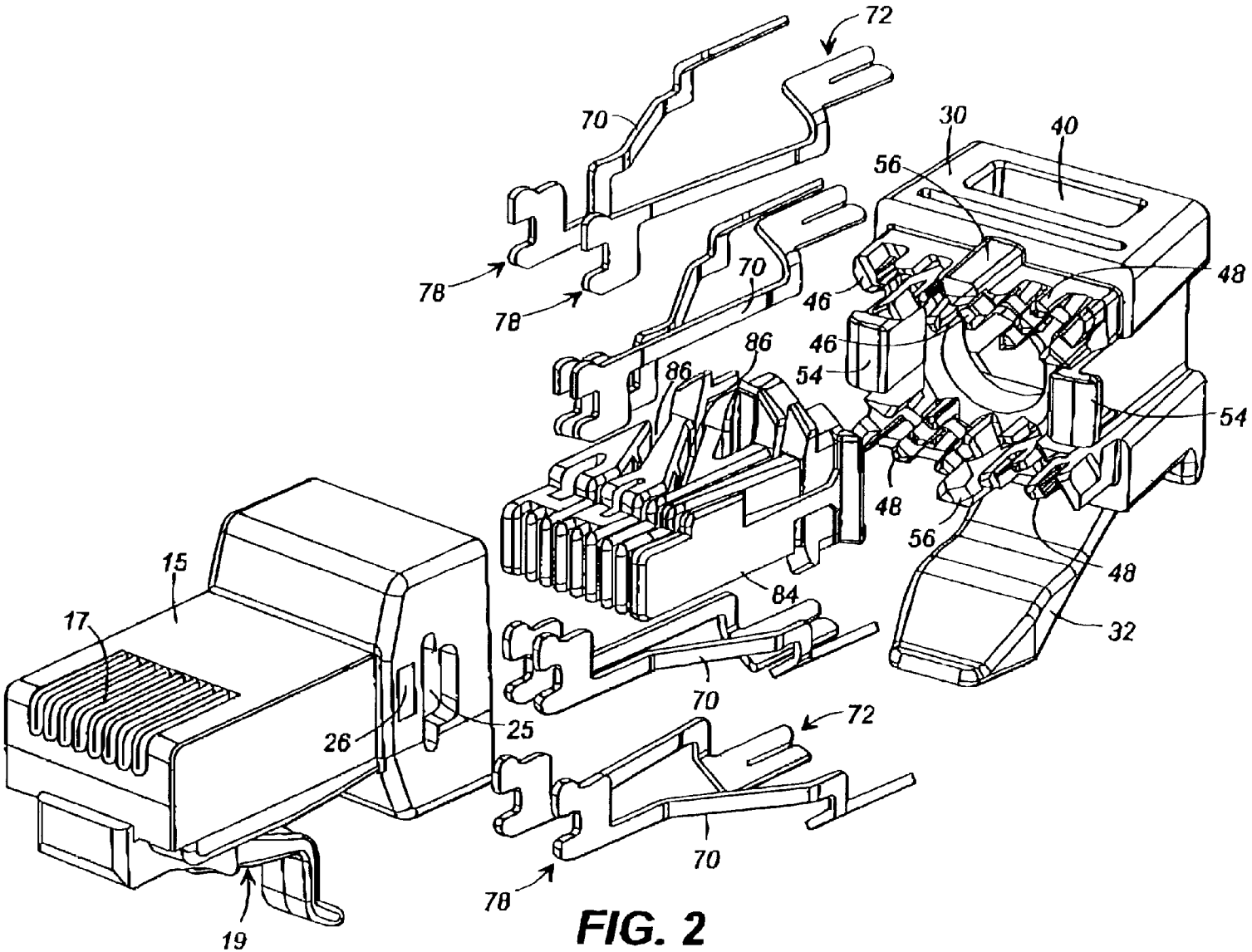
FIG. 2 is an exploded view of the high frequency communication plug according to the present invention illustrating the jack interface housing, the strain relief housing, the blade carrier and the tunable blades.
Figure 3:
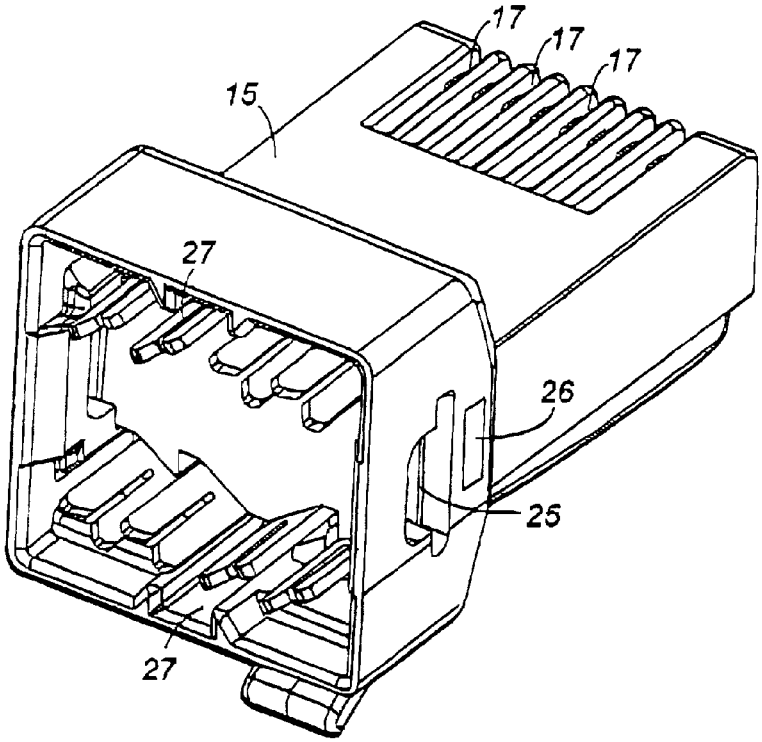
FIG. 3 is a perspective view of the jack interface housing.

Referring now to FIG. 2, the internal components of communication plug 12 are shown. Captured between the two housing components 15 and 30 is carrier 84, which is channeled or grooved to carry a plurality of tunable blades 70. To secure carrier 84 to jack interface housing 15, carrier 84 includes a pair of catch members 87, shown best in FIG. 8 (only one catch member shown), that are configured for reception in apertures 26 in jack interface housing 15. Tunable blades 70 have both an insulation displacement connection (IDC) end 72, for electrical communication with conductors from the cable, and a jack interface end 78, for electrical communication with jack springs in the jack. Tunable blades 70 are positioned in grooves 86 of blade carrier 84 such that IDC ends 72 are positioned towards strain relief housing 30 and jack interface ends 78 are positioned towards jack interface housing 15 for alignment in slots 17 of the housing 15. FIG. 3 illustrates the orientation of the blades 70 when carrier 84 is inserted in housing 15.

The communication plug described herein is the subject of copending application, Ser. No. 08/922,920, filed Sep. 3, 1997 by Ensz et al., concurrently with the instant application.

Strain Relief Housing

Strain relief housing 30 will now be described with reference primarily to FIGS. 4 and 5. Housing 30 is adapted to receive a cable carrying conductors to be terminated through rectangular opening 36 (see FIG. 1) and through passage 34 to cable circular passage 38 (see FIG. 5*c*). Circular passage 38 is designed to receive round cable carrying conductors arranged in a substantially circular fashion. However, by means of rectangular opening 36, a ribbon type cable can be terminated by stripping the outer jacket thereof and passing only the enclosed conductors through circular passage 38.

Surrounding circular passage 38 and extending from the face end of the housing are a plurality of projections or prongs comprising segregation prongs 46 and conductor separating prongs 48. Shown best in FIG. 5*a*, these prongs define a plurality of conductor control channels 50 for receiving the insulated conductors from the cable. In the embodiment shown, the layout of the prongs is designed to terminate an eight conductor cable consisting of four conductor pairs. Each conductor pair naturally dresses towards a separate corner with conductor separating prongs 48 separating one conductor from another in the same pair and segregation prongs 46 separating the conductor pairs from one another. Segregation prongs 46 are preferably larger than conductor separating prongs 48 to minimize the potential for crosstalk interference between the conductor pairs. In addition to defining conductor control channels 50, the prongs, which are bifurcated, also define IDC control channels 52 for receiving the IDC ends 72 of tunable blades 70 (see FIGS. 7 and 9) that make an electrical connection with the cable conductors. Tunable blades 70 and their IDC ends 72 are discussed in more detail hereinafter.

Figure 4:
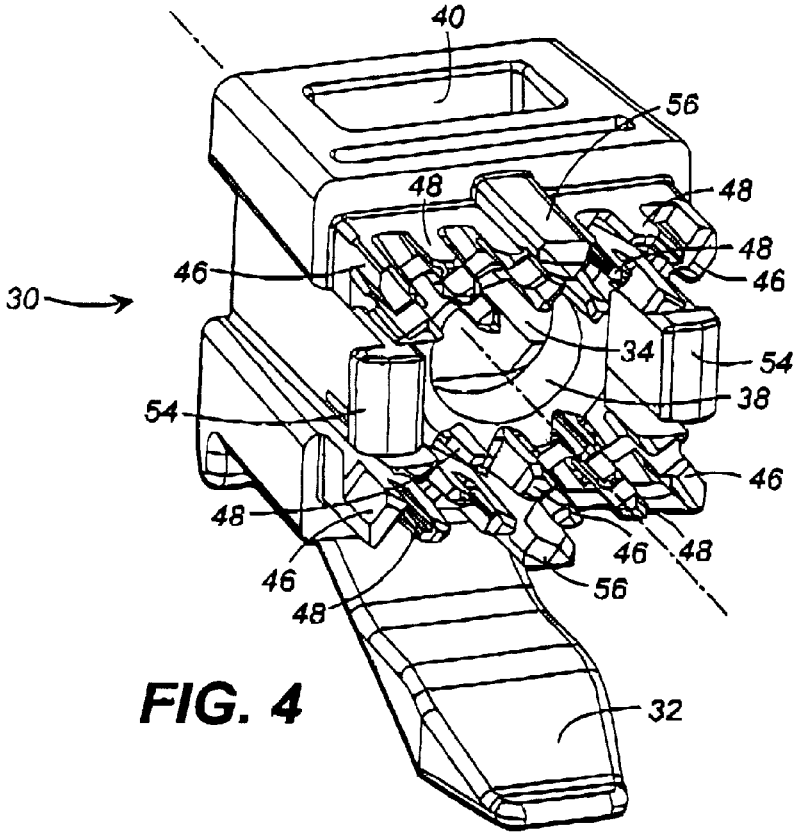
FIG. 4 is a perspective view of the strain relief housing.
Figure 5A:
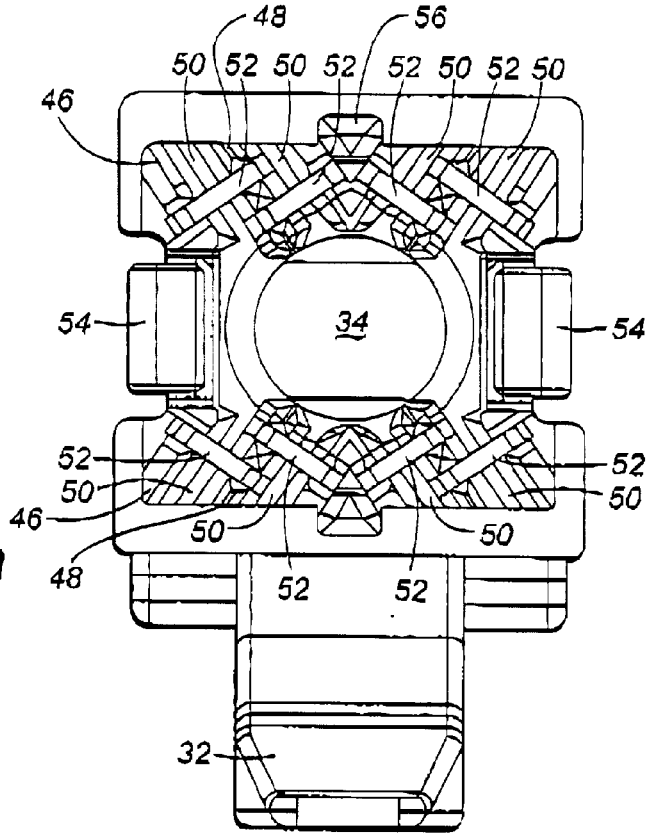
FIG. 5*a* is a front elevation view of the strain relief housing showing the channels for receiving the individual conductors and the blades.

As can be seen in FIG. 5*a*, positioning conductor pairs towards separate corners results in a substantially radial or circular arrangement relative to the centerline of passage 34 (see FIG 4). This circular design is especially advantageous for terminating round cables as the conductors are already arranged in a generally circular fashion. As discussed hereinbefore, one problem an assembler faces in terminating a round cable is mapping conductor pairs from their positions in the cable to a linear arrangement for connecting to a modular plug. The circular design of the instant invention allows a technician merely to rotate the cable until the conductors align with the desired conductor control channels 50 without having the conductors cross-over one another. Furthermore, the circular design reduces variability in terminating a cable by defining the location of the individual conductors in space via control channels 50. Each pair of wires serves a different signal channel, and are readily identifiable as by color coding so that they may be properly placed in the radial array to connect to the corresponding blades (see, for example, FIG. 7*a* and 7*c*).

Another advantage of strain relief housing 30 is that none of the conductor pairs needs to be split, i.e., each connector of the pair routed to a different location, when terminating to control channels 50. As will be made clear hereinafter, tunable blades 70 and carrier 84 accomplish the translation from a circular arrangement of conductors to a linear, side-by-side arrangement of jack spring contacts. Eliminating the requirement on the part of the installer to split one of the conductor pairs and thereby create crossovers provides for still higher reliable connections by eliminating that mapping step. Inasmuch as strain relief housing 30 provides a conductor interface that requires minimal disturbance to the radial arrangement of the conductors from the circular cable and segregation prongs 46 are used to isolate conductor pairs from each other to the greatest extent possible, crosstalk between the conductors is held to a minimum thereby maximizing the signal to noise ratios for the conductor pairs.

Figure 5B:
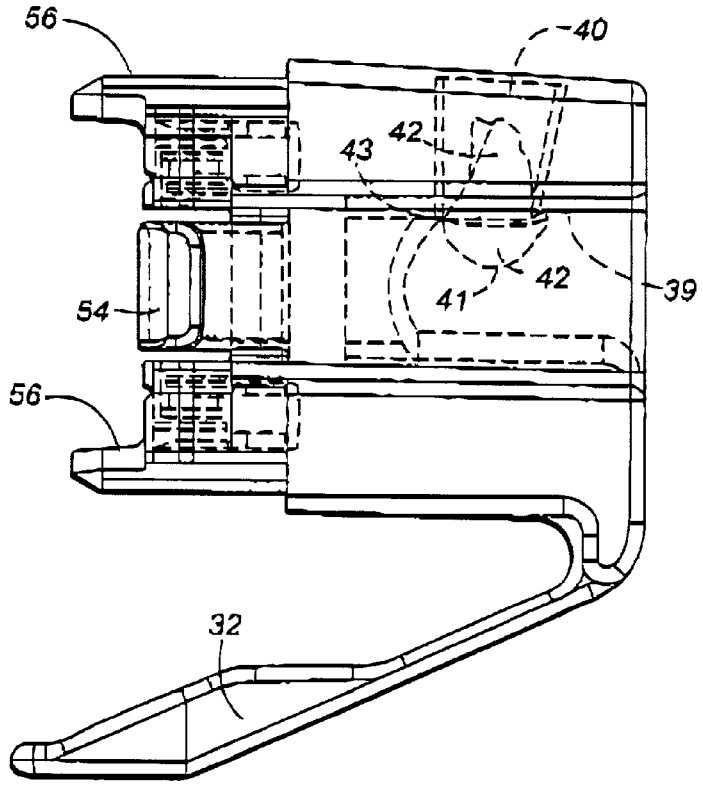
FIG. 5*b* is a side elevation view of one side of the strain relief housing showing the position of the anchor bar.
Figure 5C:
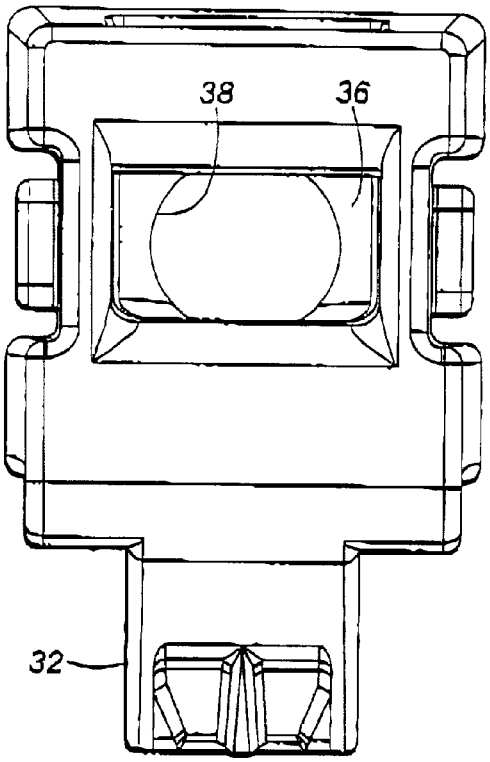
FIG. 5*c* is a rear elevation view of the strain relief housing showing the end where the cable or cord enters the housing.
Figure 5D:
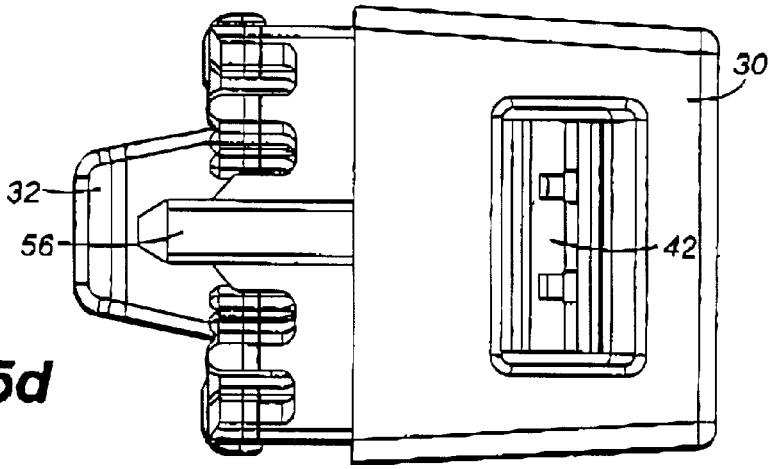
FIG. 5*d* is a plan view of the strain relief housing showing the top of the housing.
Figure 5E:
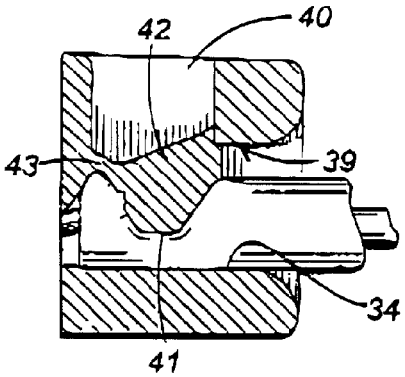
FIG. 5*e* is a detailed cross-sectional view of the anchor bar in engagement with a cable or cord.

Strain relief housing 30 provides strain relief for a terminated cable via an anchor bar 42. Anchor bar 42, which includes a surface 41 for engaging the cable, is initially disposed in opening or chamber 40 in the top of strain relief housing 30. As shown in FIGS. 5*b* and 5*e*, when anchor bar 42 is in this inoperative position, it is supported in opening 40 via hinge 43 and temporary side tabs (not shown) extending from the walls forming opening 40. When the cable is in place in passage 34 and is ready to be secured, downward force is applied by the installer or operator to anchor bar 42 such that anchor bar 42 is compressed and pivots about hinge 43 until it enters passage 34 so that surface 41 is substantially parallel with the axis defined by chamber 34 (see FIG. 5*e*). In this position, surface 41 enters into engagement with the cable jacket so that the cable is firmly held within chamber 34, but the structural integrity of the cable is not unduly distressed. Once inside chamber 34, anchor bar 42 tends to retain its original shape and a portion thereof engages the upper surface 39 of the wall forming chamber 34, as shown in FIG. 5*e*. Once in its operative position, anchor bar 42 is effective in preventing relative movement between the strain relief housing 30 and the cable external to the housing from affecting the cable position internal to the housing. The anchor bar as just described is the subject of U.S. Pat. No. 5,186,649 to Fortner et al., which is herein incorporated by reference.

Strain relief housing 30 and jack interface housing 15 are joined together by the alignment of positioning guides 56 (see FIGS. 4 and 5*d*), extending from strain relief housing 30, in complementary positioning channels 27 in jack interface housing 15 (see FIG. 3). Once the two housing pieces are aligned and pressed together, attachment clips 54 snap into side apertures or locking slots 25 in jack interface housing 15 for a tight and secure fit. Separating the two housing pieces requires simultaneous inward pressure on attachment clips 54 while pulling the two housing pieces apart. Once attachment clips 54 are free from side apertures 25, the housing pieces separate easily.

When the two pieces, strain relief housing 30 and jack interface housing 15, with carrier 84 containing the blades 70 in position in housing 15, are forced together, the wires in their channels in housing 30 are each forced into a corresponding IDC positioned to receive it, thereby completing the connection between wire and its corresponding blade 70.

Tunable Blade Structure

Referring now to FIGS. 6 and 7*a* through 7*c*, a crosstalk assembly comprising a tunable blade structure for use in high frequency communication plug 12 is shown. The illustrated embodiment is for terminating an eight conductor cable in which the conductors 70*a*, 70*b*, 70*c*, 70*d*, 70*e*, 70*f*, 70*g* and 70*h* are arranged in four conductor pairs, I, II, III and IV. The tunable blade structure of the present invention consists of four pairs of conductive members comprising tunable blades 70. Tunable blades 70 include IDC ends 72, for electrically connecting with the conductors from the cable, as discussed in the foregoing, and spring contacting jack interface ends 78, which in the preferred embodiment are advantageously bifurcated, for establishing electrical connections with jack springs held in a jack or receptacle and forming locating slots in the ends.

Each IDC end 72 is bifurcated and comprises dual, elongated prongs 74 forming a narrow slot 76 therebetween. The tips of dual prongs 74 are beveled to facilitate reception of an insulated conductor from the cable and the inner edges of the prongs have sharp edges for cutting through the conductor insulation. IDC ends are geometrically arranged in blade carrier 84 to match the configuration of the IDC control channels 52 in strain relief housing 30 (see FIGS. 5*a* and 7*c*) and are so arranged by the carrier 84, as discussed hereinafter. In operation, dual prongs 74 are positioned in their corresponding IDC control channel 52 so that the two prongs straddle a conductor held in an associated conductor control channel 50 (see FIG. 5*a*) and cut through its insulation to establish electrical contact. Slot 76 is sufficiently narrow to ensure that the insulation of the conductor is pierced by dual prongs 74 as the conductor is received in slot 76 so that the prongs are in electrical contact with the wires or conductors. Advantageously, a highly reliable electrical connection is formed with substantially all the conductor insulation remaining in place.

As discussed above, crosstalk between conductors can become problematic for modular plugs, especially when operated at high frequencies. However, in the instant invention, tunable blades 70 can be "tuned" to optimize crosstalk that may occur by varying the inductive and capacitive coupling developed between the blades. Tunable blades 70 have three regions for adjusting the device's electrical properties as shown in FIG. 7*b*: capacitive coupling region 92, inductive coupling region 94 and isolation region 96. Capacitive coupling region 92 is located at the jack interface end 78. In this region, each blade is formed with a plate position 90 so that the blades are formed into substantially parallel plates spaced from one another. When carrying electrical signals, these plates form capacitors causing capacitive coupling of signals between the blades thereby creating crosstalk. Similarly, because one of the conductor pairs needs to be split (usually the pair designated 70*e* and 70*f* in FIG. 7*a*) when aligning the conductors side-by-side, the two tunable blades, 70*e* and 70*f* must cross-over the other blades (see FIGS. 6 and 7*a*), thereby creating inductive crosstalk. Each of these blades 70*e* and 70*f* is formed with a u-shaped portion, 93, 95 respectively, which forms an inductive loop in inductive coupling region 94. This inductive loop functions to generate crosstalk. Isolation region 96, in which the blades are well spaced and insulated from one another, comprises the remainder of tunable blades 70 between the two ends.

Based on the intended application, and the particular frequencies of the signals to be carried, the plug fabricator can manipulate the capacitance and inductance developed between the blades to optimize the effects of crosstalk. For example, capacitance between any pair of adjacent blades can be adjusted in capacitive coupling region 92 by changing the surface area of the blade plates 90 in that region, changing the distance between the blade plates 90, or by changing the material separating the blade plates to an alternative material having a different dielectric constant or merely leaving the space open between the plates. In inductive coupling region 94 the length of the inductive loops can be changed as can the material separating the loops. Finally, the positioning of the capacitive coupling region 92, inductive coupling region 94, and isolation region 96 can be varied as a further adjustment to the electrical properties. These various adjustments are made during design and manufacture of the blades and the blade carrier. Thus, these components may actually be included in a family of slightly different construction depending upon the intended frequency of operation.

While it will likely be desirable in future applications to eliminate virtually all crosstalk in the communication plug, legacy systems (i.e., current jacks) require a predetermined amount of crosstalk in the plug for optimum performance. Legacy jacks are engineered to compensate for crosstalk in the communication plug; thus, a well designed plug should generate crosstalk that is complementary to that used in the jack so the combination of the two crosstalk signals cancel each other out. In addition to generating the appropriate crosstalk, the communication plug is also required to meet certain terminated open circuit (TOC) electrical characteristics as proscribed in standards set forth by the International Electrotechnical Commission (IEC). These standards effectively place limits on the capacitance developed between the blades or conductors in a plug. With these prerequisites, the high frequency communication plug according to the instant invention is particularly effective for applications involving legacy jacks. For example, instead of tuning out crosstalk, capacitive coupling region 92, inductive coupling region 94 and isolation region 96 can be adjusted to generate a predetermined amount of crosstalk based on the frequency of operation and the compensating crosstalk characteristics of the jack in which the plug will be used. Moreover, inductive coupling region 94 provides the ability to adjust the ratio of inductive and capacitive coupling so that the amount of capacitive coupling is in compliance with IEC standards. Advantageously, the communication plug according to the instant invention is both backward compatible with existing jacks and can be tuned to accommodate the requirements of future jacks or evolving electrical standards.

It has been found in practice that positioning capacitive coupling region 92 and inductive coupling region 94 closest to jack interface end 78 is the most effective because the jack is designed to counteract or compensate for the crosstalk introduced in the plug as discussed hereinbefore. Moving capacitive coupling region 92 and inductive coupling region 94 away from jack interface end 78 introduces an undesirable delay in canceling out crosstalk introduced in the plug. The degree of tuning thus available can materially reduce or adjust crosstalk, but, as discussed hereinbefore, there is dependence upon the frequency of the signals being carried by the conductors. The installer can, where desirable, vary the capacitance between two adjacent plates by drilling one or more holes in either or both of the plates. This has the effect of slightly decreasing the capacitive coupling to avoid overcompensation when seeking to eliminate crosstalk or to comply with IEC standards that limit the amount of capacitive coupling allowed in the plug.

Figure 6:
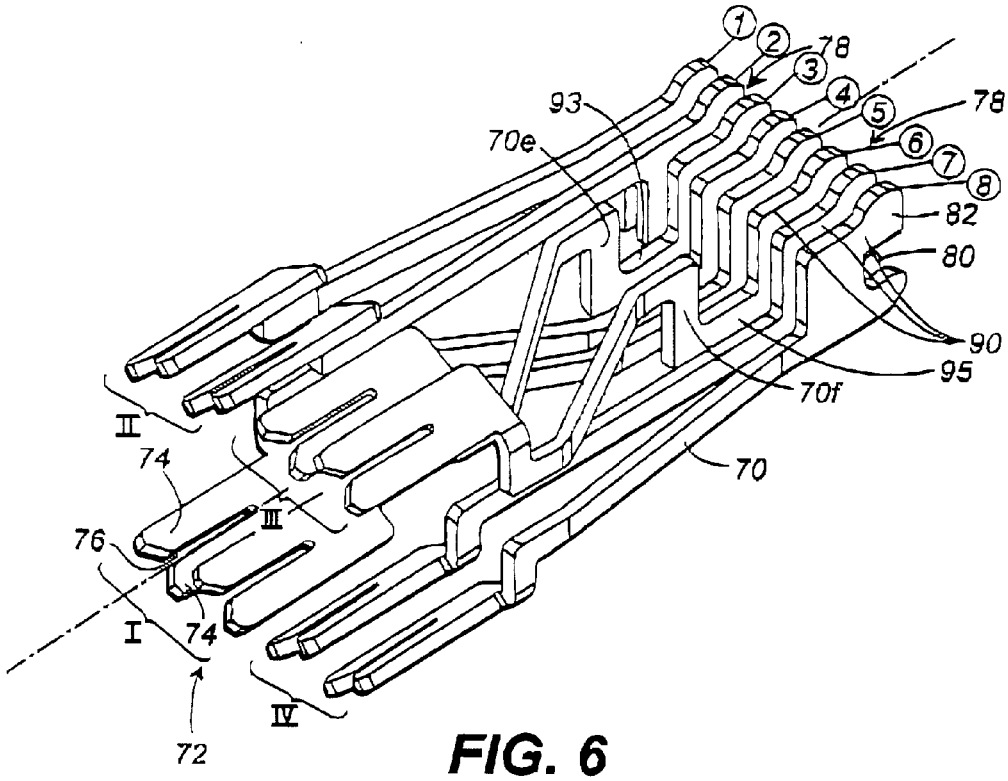
FIG. 6 is a perspective view of the tunable blades as they are oriented when in the jack interface housing.
Figure 7A:
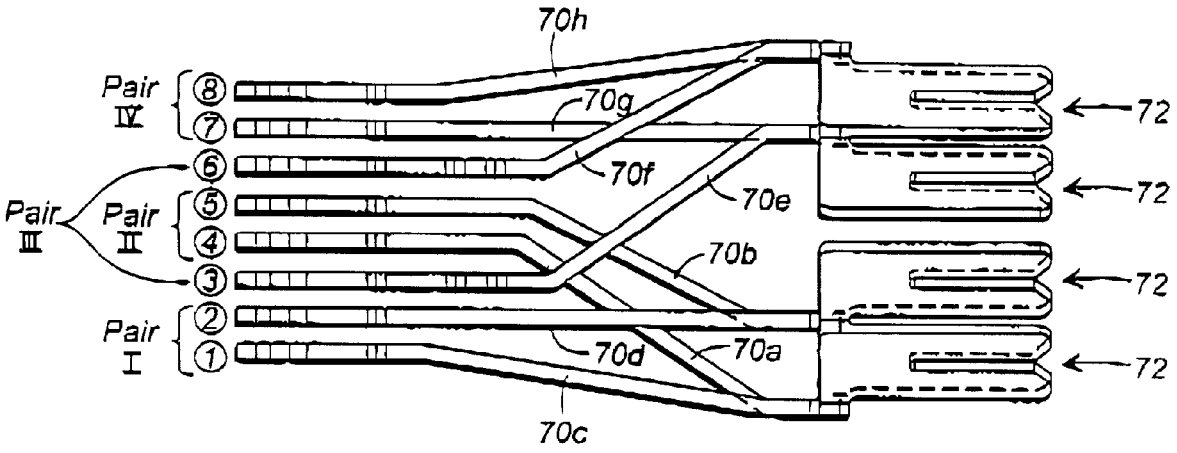
FIG. 7*a* is a plan view of the tunable blades.
Figure 7B:
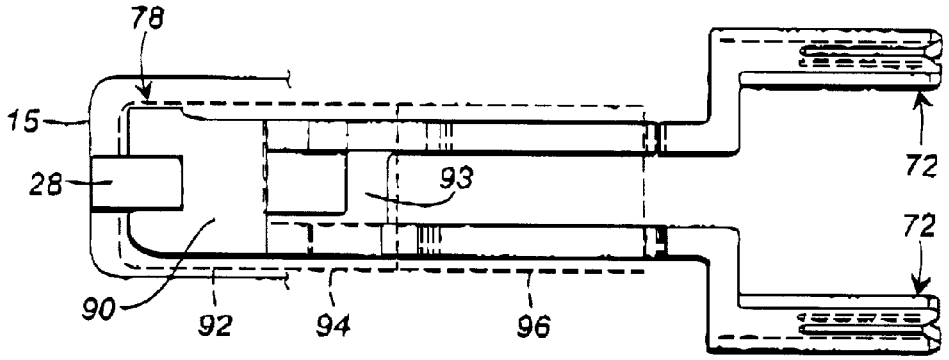
FIG. 7*b* is a side elevation view of the tunable blades showing the electrically significant regions along with the blades' relationship to the locating bar.

In the blade assembly as shown in FIGS. 6 and 7*a*, it can be seen that each of the blades 70*n* has a capacitance plate 90, and blades 70*e* and 70*f* have u-shaped portions 93 and 95 respectively. The inductive loops formed by portions 93 and 95 generate more crosstalk than the blades without the u-shaped portions. The inductive loops are effective in generating the desired amount of crosstalk in the plug to complement counteracting crosstalk designed into a jack. This is especially important because IEC standards place limits on the amount of capacitive coupling that can be designed into the plug. Thus, the ratio of capacitive to inductive crosstalk can be adjusted as desired.

The blades 70 have been shown in one configuration for four pairs of wires to be connected thereto. It can be appreciated that the tunability of the blades having the unique properties discussed can be used to advantage in other configurations for different numbers of wire pairs.

Tunable blades 70 are the subject of copending application, Ser. No. 08/922,580, filed Sep. 3, 1997 by Larsen et al., concurrently with the instant application.

Carrier

Figure 8:
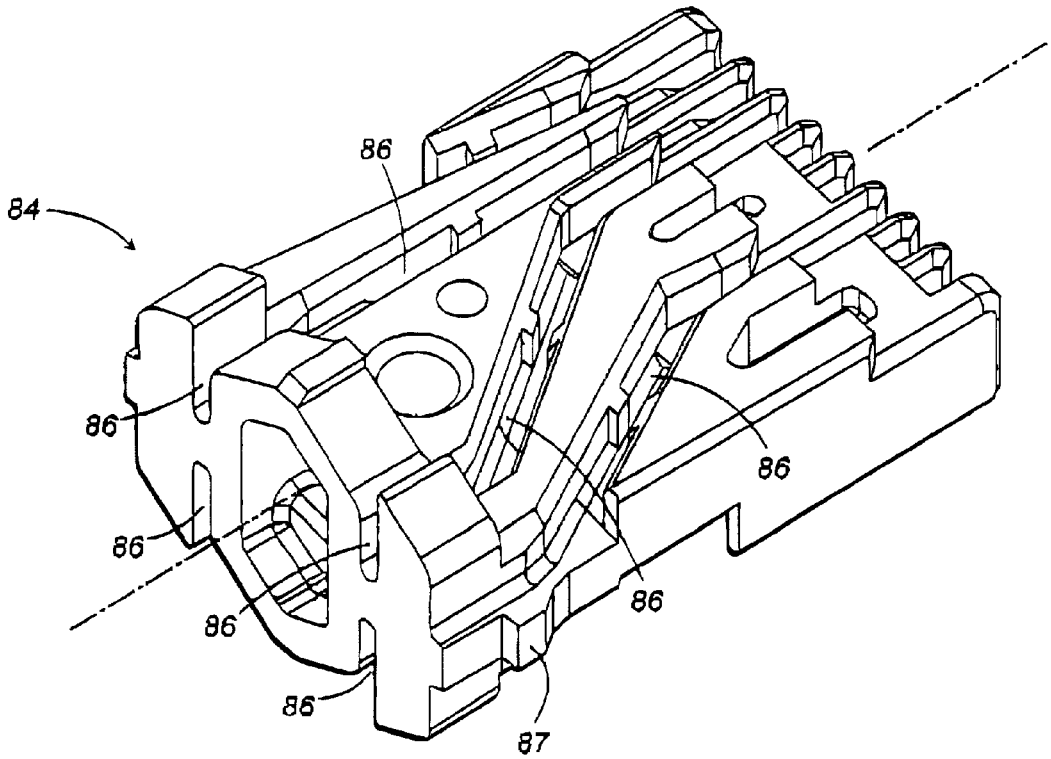
FIG. 8 is a perspective view of the blade carrier for routing and holding the blades.
Figure 9:
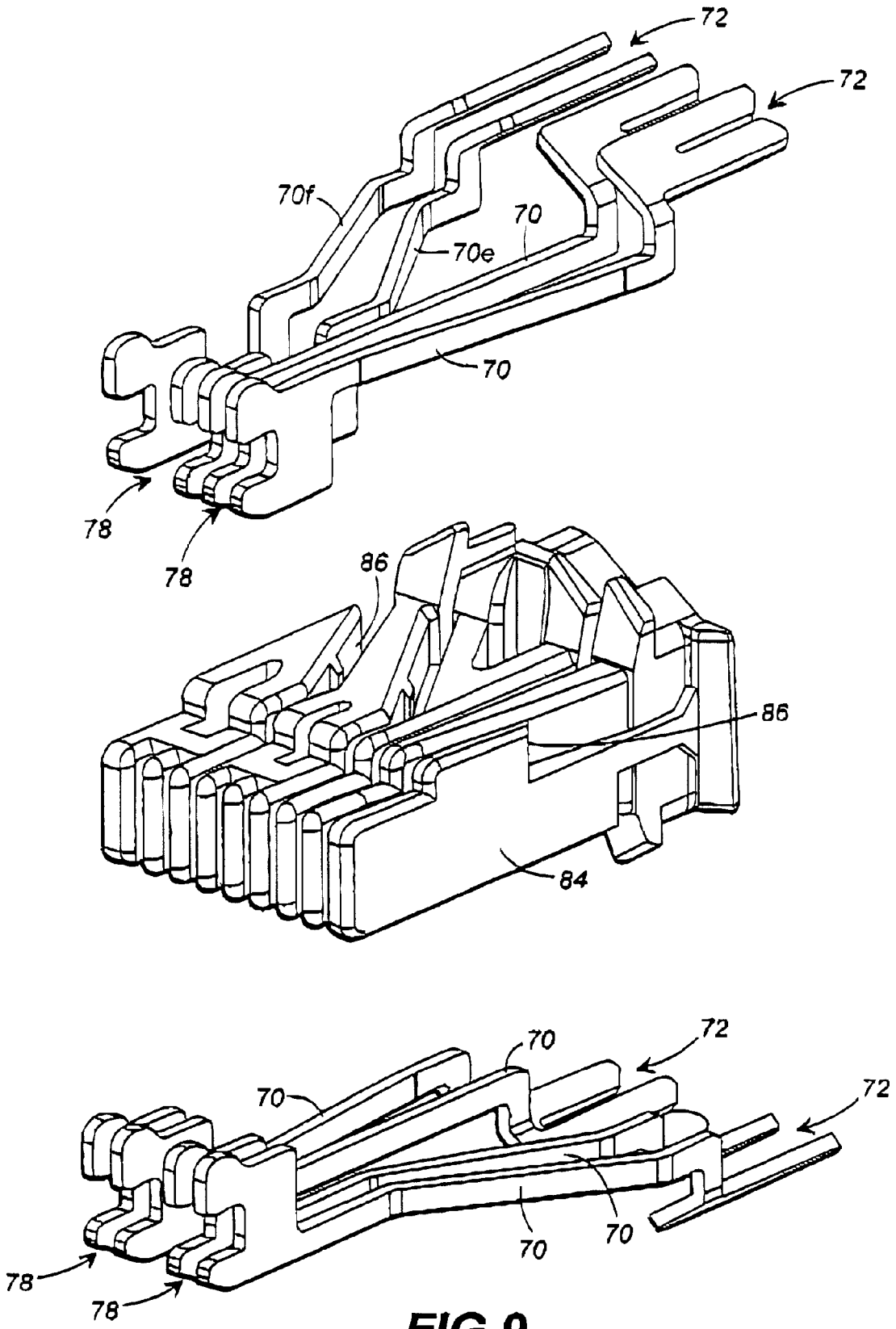
FIG. 9 is a perspective view showing the relationship between the tunable blades and the blade carrier.

In order that tunable blades 70 are positioned in their proper positions with respect to strain relief housing 30 in general and IDC control channels 52 in particular, carrier 84 is used as shown in FIGS. 8 through 11. Carrier 84 is preferably made of a suitable plastic or dielectric material, which may be different for different electrical frequencies of use. With reference to FIG. 8, a plurality of grooves or channels 86 are disposed on the upper and lower (not shown) surfaces of blade carrier 84. FIG. 9 shows the relationship of blades 70 to blade carrier 84 as the blades are received in grooves 86. Carrier 84 is instrumental in adjusting the electrical properties of capacitive coupling region 92, inductive coupling region 94 and isolation region 96 (see FIG. 7) as discussed above. For example, the type of material blade carrier 84 is made from, the width between grooves 86, and the positioning of the capacitive coupling, inductive coupling and isolation regions with respect to each other all affect the electrical characteristics of the plug and require cooperation between blades 70 and blade carrier 84. It is envisioned that for a particular application, plug designers will develop the correct geometric design of both blades 70 and blade carrier 84 so that the desired electrical response is achieved. For example, in place of blades 70 and carrier 84, a wired lead frame structure could be used in which the wires are bent or configured in such a manner that the desired electrical characteristics (i.e., capacitance, inductance) between the wires are achieved. Regardless, of the structure or carrier used, or the type of conductor used (i.e., blade, wire), the conductors should be sufficiently isolated from one another to prevent excessive signal coupling due to operation at high frequencies.

Figure 10:
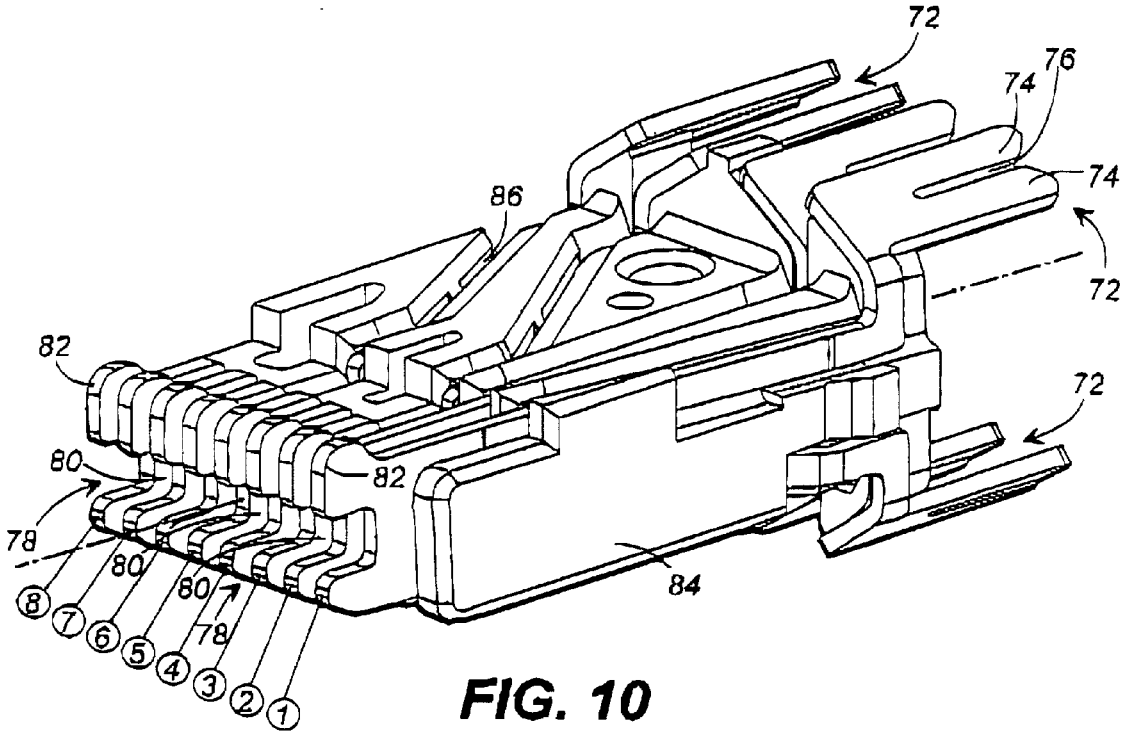
FIG. 10 is a perspective view from the rear of the tunable blades positioned in the blade carrier.
Figure 11:
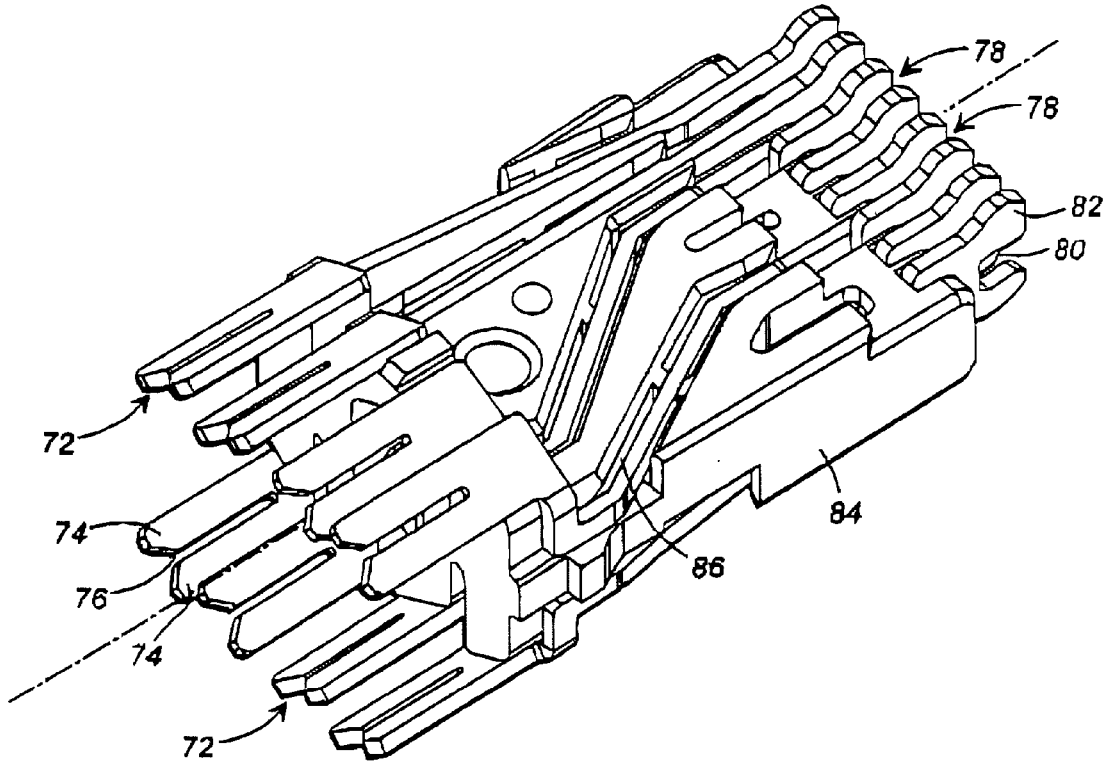
FIG. 11 is a perspective view of the tunable blades positioned in the blade carrier.

FIGS. 10 and 11 provide two views of the blade-carrier assembly together. These figures provide the best illustration of the translation from a substantially circular arrangement at IDC ends 72, to a linear arrangement at jack interface end 78. It should be clear to one skilled in the art that as alternative cable or cord types come into favor, blades 70 and carrier 84 can be engineered to match the conductor arrangement within the cable or cord. Both the structural and electrical benefits of leaving the cable conductors relatively undisturbed when terminating to IDC ends 72 were discussed earlier.

Figure 7C:
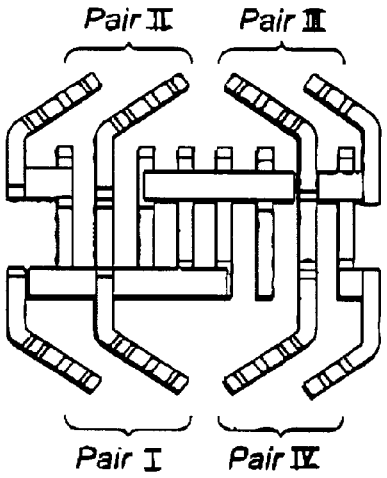
FIG. 7*c* is a front elevation view showing the conductor connecting interface ends of the blades.

A clearer understanding of the function of the grooves 86 and the routing of the blades 70 therein can be had with reference to FIG. 7*a* and 7*c* which, although FIG. 7*a* depicts the blades 70, it is equally a map of the grooves on both the upper and lower surfaces of the carrier 84 as looked at from above. The blade arrangement of FIG. 7*a* is for use with a cable having four conductor or wire pairs—I, II, III and IV. In FIG. 7*c*, it can be seen that the blades for pairs II and III are in grooves on the upper surface of the carrier body 84 and those for pairs I and IV are in grooves on the lower surface of the carrier body 84. Thus, the blades for pairs I and IV are spaced from pairs II and III by approximately the thickness of the body of carrier 84. Referring to FIG. 7*a*, and treating it as a map of the grooves in carrier 84, the pair of blades 70*g* and 70*h*, which connect to wire pair IV at the connectors 72 are routed by the grooves in the lower surface of member 84 straight to their position in the planar array at the jack spring end at terminals 7 and 8. The pair of blades 70*a* and 70*b*, which connect to wire pair I, are routed by their grooves in the lower surface of member 84 to terminals 4 and 5, as shown in FIG. 7*a*.

The pair of blades 70*e* and 70*f*, which connect to wire pair III, are routed by their grooves in the top surface of carrier body 84 to terminals 3 and 6 respectively, thus causing the terminals for pair III to straddle those for pair I, as shown. This routing results in blade 70*f* on the upper surface crossing over blade 70*g* on the lower surface, and blade 70*e* on the upper surface crossing over blades 70*a* and 70*b* on the lower surface. The crossing blades are, therefore, separated by the thickness of the carrier, which spacing results in less interaction between the crossing blades.

In addition, the pair of blades 70*c* and 70*d*, which correspond to pair II, are routed on the upper surface of member 84 directly to terminals 1 and 2. Such routing causes blade 70*d* to cross over blade 70*a* on the lower surface.

Thus, it can be seen that carrier 84 produces a transition of the blades from a substantially radial array to a planar array, thereby relieving the installer of the tedious process of forming the transitions himself, which requires a routing such as is shown in FIG. 7*a*.

The assembly consisting of tunable blades 70 in conjunction with blade carrier 84 is the subject of copending application, Ser. No. 08/923,382 filed Sep. 3, 1997, by Lin et al., submitted concurrently with the instant application.

Locating Bar

The blades 70, when mounted in carrier 84, and when carrier 84 is in turn mounted in jack spring housing 15, have their jack interface ends 78 aligned in a substantially planar array, as best seen in FIG. 10, thereby accomplishing a translation from a circular array or grouping of wires to a linear, side-by-side array of conductors. Inasmuch as the blades are placed within the grooves or channels 86 in carrier 84 but not otherwise affixed thereto, it is desirable that there be some means of ensuring that the planar array of ends 78 offers a uniform set of contacts for the jack springs, with no misalignment.

Figure 12:
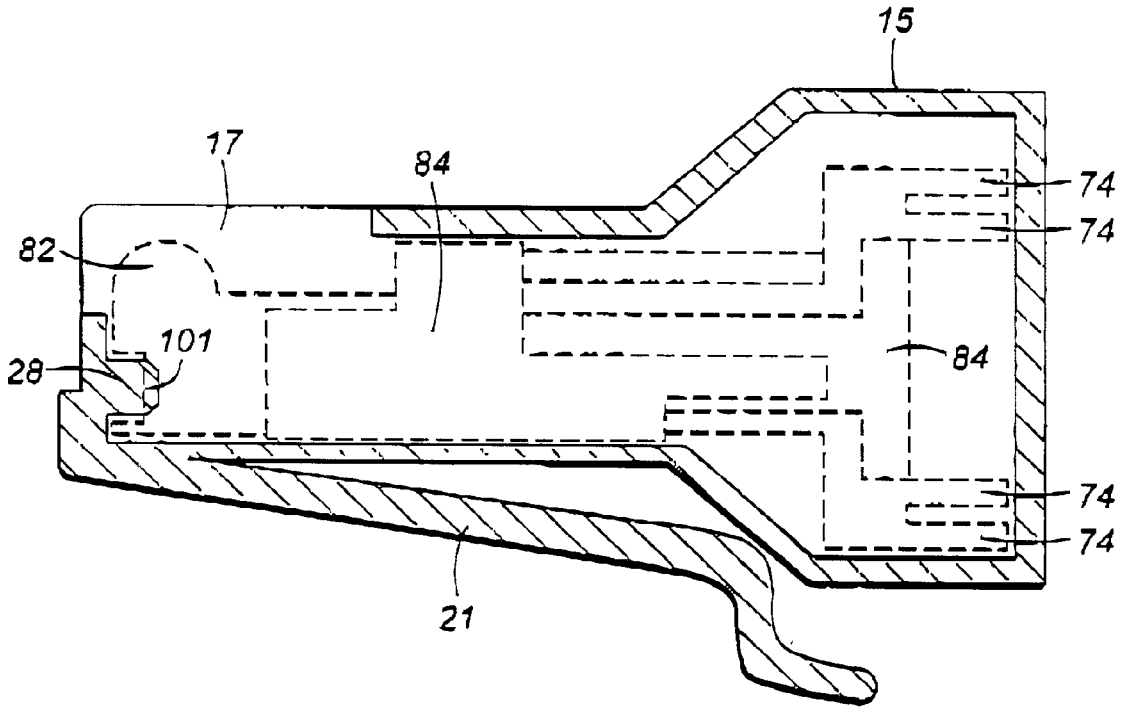
FIG. 12 is a cross-sectional elevation view of the jack spring housing.
Figure 13:
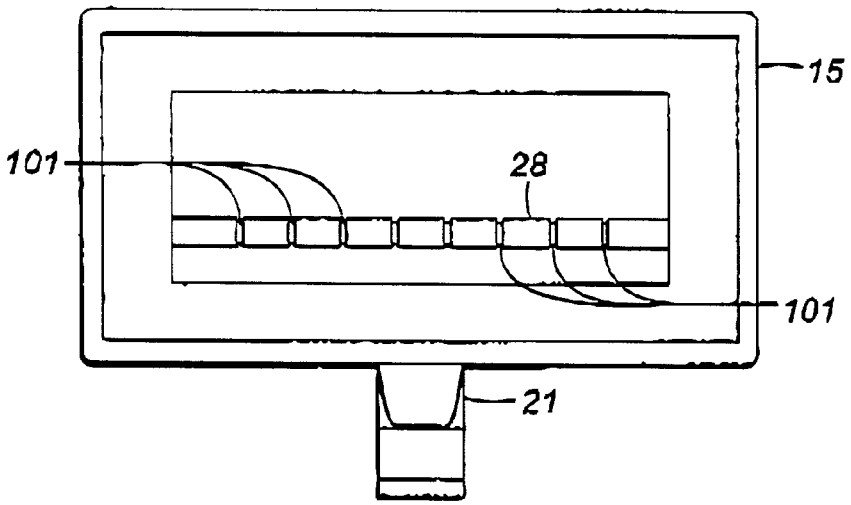
FIG. 13 is a front elevation view of the jack spring housing of the invention.

In accordance with the present invention, uniform alignment of the blades 70, and, more particularly, blade ends 78 is accomplished by means of a locating and alignment bar 28, as best seen in FIGS. 12 and 13. Bar 28 has a plurality of slots or ribs 101 therein, uniformly spaced apart, for receiving the ends 78 of the blades 70. More particularly, the top and bottom of the alignment notch 80 in each blade slips around the alignment bar 28 at a slot or rib 101. In this manner, the blades 70 are prevented from shifting laterally. Blades 70 are also aligned vertically, or, more properly, are prevented from becoming vertically misaligned by means of bar 28 being dimensional to slip with the alignment notches 80 of the several blades 70, in a slip fit. Thus, alignment bar 28 locates and fixes the position of each blade 70 in the array of blades, and proper electrical contact between each jack spring node 82 and its corresponding jack spring is assured.

This arrangement for locating jack spring nodes 82 is an improvement over the prior art as the precision with which the blades themselves are engineered guarantees the final blade positioning. Conversely, previous methods relied upon assembly tooling and proper assembly techniques to finalize blade positioning. For example, it is common for a blade having insulation piercing tangs to be pressed into the end portion of an insulated wire that is disposed within a trough of a plug body. This technique tends to suffer from both electrical connection failures and misalignment of the blades themselves.

The jack spring housing and locating bar 28 is the subject of copending application, Ser. No. 08/922,623, filed Sep. 3, 1997, by Reichard et al., concurrently with the instant application.

The principles of the invention have been illustrated herein as they are applied to a communications plug. From the foregoing, it can readily be seen that the unique plug is one that minimizes operations by the installer or other user in terminating a cable, whether of the flat, ribbon type or the circular tube type. The unique strain relief housing is applied or connected to the end of the cable with a minimum of operations, the only operation being the flaring of the wires of the cable in a radial pattern, without the necessity of cross-over or the like. The blade carrier routes the tunable blades to produce a linear array of terminals at its end remote from the cable and the blades are tunable to compensate for crosstalk included in the carrier assembly. When the carrier is inserted in the jack spring housing, the locating bar ensures that the blades remain fixed in proper position, and assembly of the plug is completed by simply pressing the strain relief housing and the jack spring housing together until they latch. The latching occurs after the IDC ends of the blades have electrically connected to the arrayed wires in the strain relief housing. Thus the operator's or installer's manipulation is limited to the initial arraying of the wires in the cable in a radial or circular pattern.

In concluding the detailed description, it should be noted that it will be obvious to those skilled in the art that many variations and modifications may be made to the preferred embodiment without substantially departing from the principles of the present invention. All such variations and modifications are intended to be included herein within the scope of the present invention, as set forth in the following claims. Further, in the claims hereafter, the corresponding structures, materials, acts, and equivalents of all means or step plus function elements are intended to include any structure, material, or acts for performing the functions with other claimed elements as specifically claimed.

We claim:

1. A strain relief housing for use in a communication plug for terminating a cable carrying a plurality of conductors, said strain relief housing comprising:

a housing member having a chamber and a passage, said chamber communicating with said passage, said passage extending through said housing member from a cable entrance end to a face end, said passage being configured to receive a cable, said passage having a centerline, and said housing member having upper and lower surfaces and being configured to receive the cable such that the cable extends from said cable entrance end to said face end;

at least a first plurality of spaced apart projections extending from said face end of said housing member and extending substantially parallel to said centerline of said passage, said first plurality of spaced apart projections being configured to position the conductors in a substantially radial array relative to said centerline of said passage such that the conductors form said radial array adjacent said face end of said housing member, whereby strain relief is provided to the cable of the communications plug; and an anchor bar movably positioned in said chamber in said housing and adapted to bear against the cable.

2. A strain relief housing as claimed in claim 1, wherein the conductors in the cable are arranged in discrete pairs, and further comprising:

a second plurality of spaced apart projections extending from said face end of said housing for segregating the discrete wire pairs from each other to form said substantially radial array of wire pairs.

3. A strain relief housing as claimed in claim 2, wherein each of the projections of said second plurality of projections is located between two projections of said first plurality of projections.

4. A strain relief housing as claimed in claim 2, wherein each of said projections of said second plurality is bifurcated to define a control channel on said face end.

5. A strain relief housing as claimed in claim 4, wherein said control channel is dimensional to receive an insulation displacement connector.

6. A strain relief housing as claimed in claim 1, wherein said housing has an opening in the upper surface thereof communicating with said chamber;

said anchor bar being pivotally connected to a wall of said chamber.

7. A strain relief housing as claimed in claim 6, wherein said anchor bar has a cable engaging surface;

a first, inoperative position in which said cable engaging surface is at an angle with respect to the outer surface of the cable and a second, operative position, wherein said cable engaging surface is parallel to and in engagement with the outer surface of the cable.

8. A strain relief housing as claimed in claim 7, wherein said chamber and said passage form a shoulder at their juncture, and said anchor bar has means for locking said bar in its operative position.

9. A strain relief housing as claimed in claim 8, wherein said means for locking comprises a notch on said anchor bar adapted to engage said shoulder when said anchor bar is in its operative position.

10. A strain relief housing as claimed in claim 1, and further comprising a trigger member attached to said lower surface.

11. A strain relief housing as claimed in claim 10, wherein said trigger member is an elongated arm having a proximal end attached to said lower surface adjacent said cable entrance end of said housing, and a free distal end, said arm extending toward said face end at an angle to said housing.

12. A strain relief housing for use in a communication plug for terminating a cable carrying a plurality of conductors, the conductors of the cable being arranged in wire pairs, said strain relief housing comprising:

a housing member having a passage extending therethrough from a cable entrance end to a face end, said passage being configured to receive the cable such that the cable extends from said cable entrance end to said face end, said face end having an upper portion and a lower portion;

a first plurality of spaced apart projections extending from said upper portion of said face end of said housing member, said first plurality of spaced apart projections being configured in a substantially linear upper array and being configured to position a first pair and a second pair of the conductors;

a second plurality of spaced apart projections extending from said lower portion of said face end of said housing member, said second plurality of spaced apart projections being configured in a substantially linear lower array and being configured to position a third pair and a fourth pair of the conductors, whereby positioning the first pair and the second pair of the conductors within said upper array and the third pair and the fourth pair of the conductors within said lower array provides strain relief to the cable of the communications plug; and a third plurality of spaced apart projections extending from said face end of said housing for segregating a first wire of each wire pair from a second wire of the wire pair.

13. A strain relief housing as claimed in claim 12, wherein said upper array is configured to separate the first pair and the second pair of the conductors from each other, and said lower array is configured to separate the third pair and the fourth pair of the conductors from each other.

14. A strain relief housing as claimed in claim 12, wherein said upper array and said lower array are arranged in a parallel relationship with each other.

15. A strain relief housing as claimed in claim 12, further comprising means for anchoring the cable in said passage.

16. A strain relief housing for use in a communication plug for terminating a cable carrying a plurality of conductors, the conductors of the cable being arranged in wire pairs, said strain relief housing comprising:

a housing member having a passage extending therethrough from a cable entrance end to a face end, said passage being configured to receive the cable such that the cable extends from said cable entrance end to said face end, said face end having an upper portion and a lower portion;

a first plurality of spaced apart projections extending from said upper portion of said face end of said housing member, said first plurality of spaced apart projections being configured in a substantially linear upper array and being configured to position a first pair and a second pair of the conductors; and a second plurality of spaced apart projections extending from said lower portion of said face end of said housing member, said second plurality of spaced apart projections being configured in a substantially linear lower array and being configured to position a third pair and a fourth pair of the conductors, whereby positioning the first pair and the second pair of the conductors within said upper array and the third pair and the fourth pair of the conductors within said lower array provides strain relief to the cable of the communications plug, wherein said upper portion includes a first quadrant and a second quadrant of said face end, and said lower portion includes a third quadrant and a fourth quadrant of said face end, and wherein said upper array is configured to position the first pair in said first quadrant and the second pair in said second quadrant, and said lower array is configured to position the third pair in the third quadrant and the fourth pair in the fourth quadrant.

17. A strain relief housing as claimed in claim 16, wherein said passage has a centerline, and said upper array and said lower array are configured to position the conductors in a substantially radial arrangement relative to said centerline of said passage such that the conductors form said radial arrangement adjacent said face end of said housing member.

* * * * *